US006582236B1

(12) United States Patent
Dian et al.

(10) Patent No.: US 6,582,236 B1
(45) Date of Patent: Jun. 24, 2003

(54) RE-USABLE WRITING SURFACE

(76) Inventors: Russell Dian, 175 E. 96th St., New York, NY (US) 10128; Bernie Yuhl, 15 N. 7th St., Kenilworth, NJ (US) 07033

( * ) Notice: Subject to any disclaimer, the term of this patent is extended or adjusted under 35 U.S.C. 154(b) by 0 days.

(21) Appl. No.: 09/577,693

(22) Filed: May 22, 2000

Related U.S. Application Data

(60) Provisional application No. 60/135,359, filed on May 21, 1999.

(51) Int. Cl.[7] ..... B43L 1/00
(52) U.S. Cl. ..... 434/408; 434/415; 434/419
(58) Field of Search ..... 434/408, 410, 434/413, 414, 415, 419; 283/81; 40/299, 594

(56) References Cited

U.S. PATENT DOCUMENTS 3,512,273 A * 5/1970 Baker, Jr. et al. ..... 434/163
4,976,647 A * 12/1990 Axtell ..... 40/421
5,024,895 A * 6/1991 Kavanagh et al. ..... 359/350
5,727,818 A * 3/1998 Schmeida ..... 283/81
5,791,910 A * 8/1998 Masson et al. ..... 434/410
5,860,235 A * 1/1999 Bilbie et al. ..... 40/299
5,938,449 A * 8/1999 Masson et al. ..... 434/415
6,067,266 A * 5/2000 Donelan ..... 365/218
6,308,445 B1 * 10/2001 Porraro ..... 283/81

* cited by examiner

*Primary Examiner*—Kien T. Nguyen
(74) *Attorney, Agent, or Firm*—Greenberg Traurig, LLP

(57) ABSTRACT

An erasable writing surface assembly that consists of two panels bonded together and sufficiently flexible so that one panel can fold onto the other panel. Each panel is composed of a three ply panel structure where at least one outer surface is composed of pencil erasable surface but, at the same time, a surface sufficient to be writable. The middle ply is composed of a paper or plastic with a desired graphics.

2 Claims, 6 Drawing Sheets

*ReflectaNote* ™ Electronic Flash Reflector
Fig. 10a
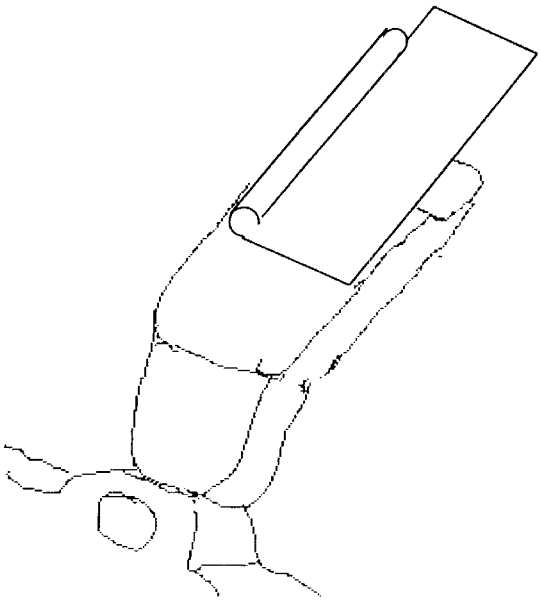
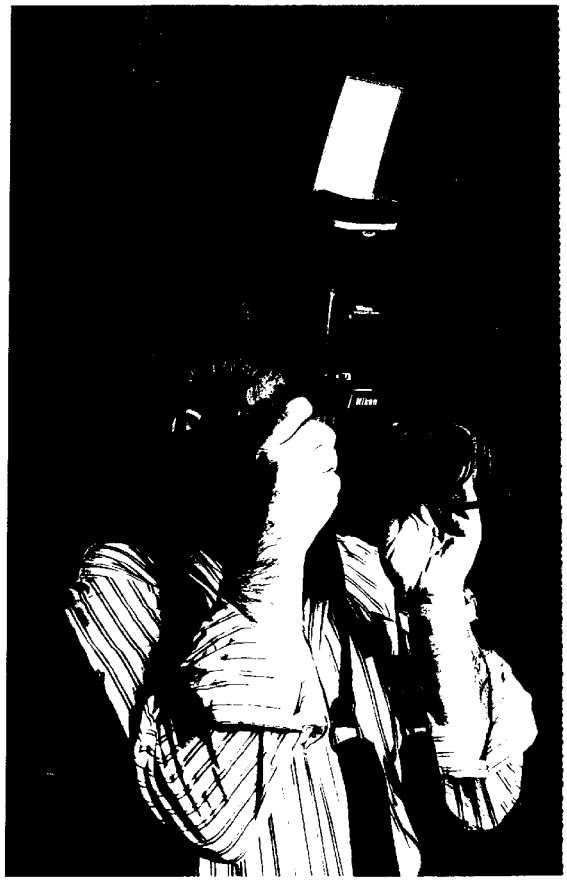
Fig. 10b

RE-USABLE WRITING SURFACE

RELATED APPLICATION

This application relies on a provisional application, U.S. Ser. No. 60/135,359, filed on May 21, 1999.

SUMMARY OF THE INVENTION

The present invention discloses an erasable writing surface assembly where the writing surface has been sufficiently modified to sufficiently reduce smudging but allowing for erasing. The assembly is configured for the particular application. For example, the writing surface assembly may be sized to be able to fit into a shirt pocket. The writing surface assembly may also be designed with any desired graphics to meet the desired application.

BRIEF DESCRIPTION OF DRAWINGS

FIGS. 10A and 10B are perspective views of one embodiment of the present invention showing the writing surface adhered to a camera.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 3:
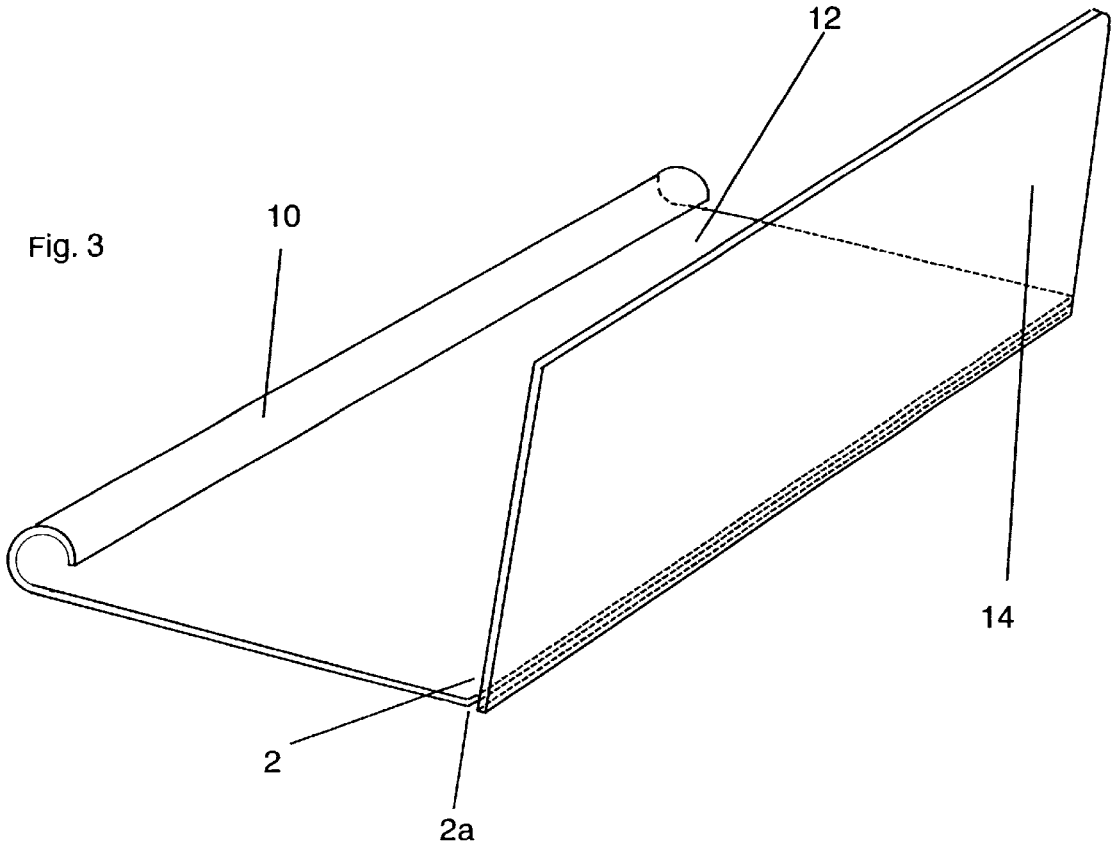
FIG. 3 is a perspective view of the writing surface of the present invention showing one embodiment of the two panels with a molded pencil molded holder.

The purpose of the present invention is to produce a writing surface that is erasable with any desired writing utensil such as a pencil and eraser, or permanent with a ball point pen. In one embodiment as shown in FIG. 3, the writing surface is sized as a small personal memo device in the form of a book. It may be sized so that it is suitable for pocket or purse or usable as an organizer accessory.

In another embodiment, the graphics of the present invention may replace a typical "to-do list " or paper. Typically, if one writes "to-do" items on paper, it is necessary to rewrite un-done items to the next day's list. This re-writing is eliminated by the present invention. A person need only erase done items. Un-done items remain on the list. The present invention may also replace typical little pieces of paper that are used as "to-do" lists.

In one embodiment, the writing surface of the present invention is water-resistance. This makes it useful in everyday applications and also specifically useful on boats or motorcycles or the military, where regular paper is less useful. In another embodiment, the present invention may contain any graphics including art work, advertising messages, a calendar or a specified message (e.g. "to do list") that is laminated between the two plastic layers (i.e. panels).

Figure 5:
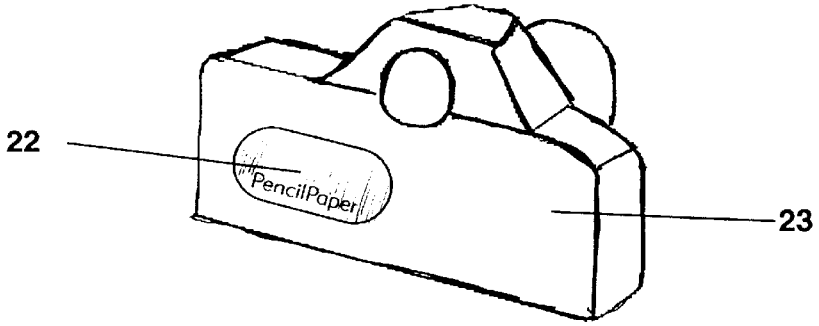
FIG. 5 is a perspective view of the writing surface of the present invention showing one embodiment of the present invention with the panel adhered to a camera.

In another embodiment, as shown in FIGS. 5, 10A and 10B, the writing surface is adhered to the back of a camera to record various data. In further embodiments, the writing surface may be sized to work with a measuring tape to jot measurements. In yet another embodiment, the writing surface can be size to be adhered to medical instruments to jot down settings that can be changed.

The advantages of the present invention include: (a) it can be sized for any application (e.g. for a "Palm Pilot"); (b) it is light weight; (c) it is durable; (d) it is water-resistant; and (e) the graphic potential for art work or advertising is limitless.

Figure 1:
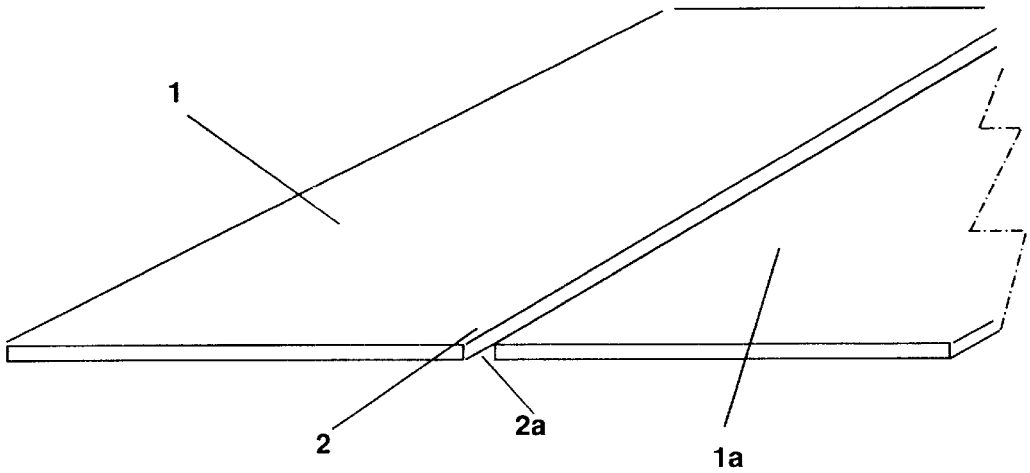
FIG. 1 is a perspective view of the writing surface of the present invention showing one embodiment of connecting the two panels.
Figure 2:
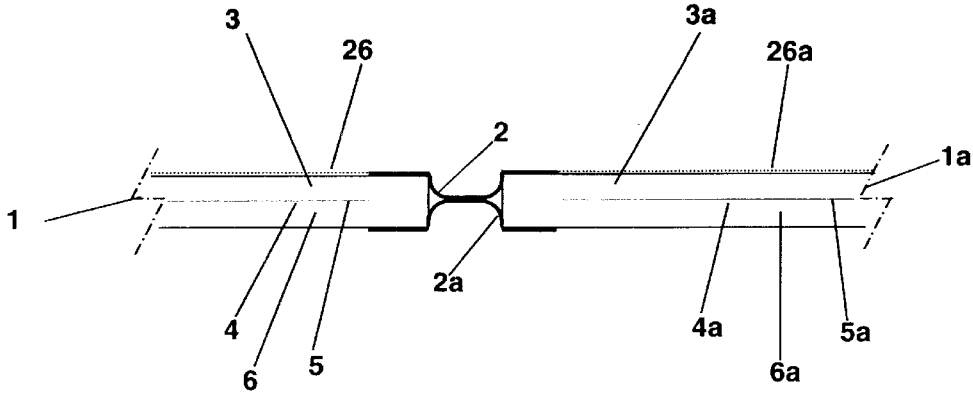
FIG. 2 is a sectional view of the writing surface of the present invention showing one embodiment of the method of connecting the two panels.

As shown in FIGS. 1 through 3, in one embodiment, the writing surface is constructed of two laminated panels that are hinged together. In one embodiment, one side of the laminate is glossy and the other side is a writable matte. When the book is closed, the writable matte sides are hidden. In another embodiment, the two laminated pages may have three or four sides composed of writable matte.

Figure 6:
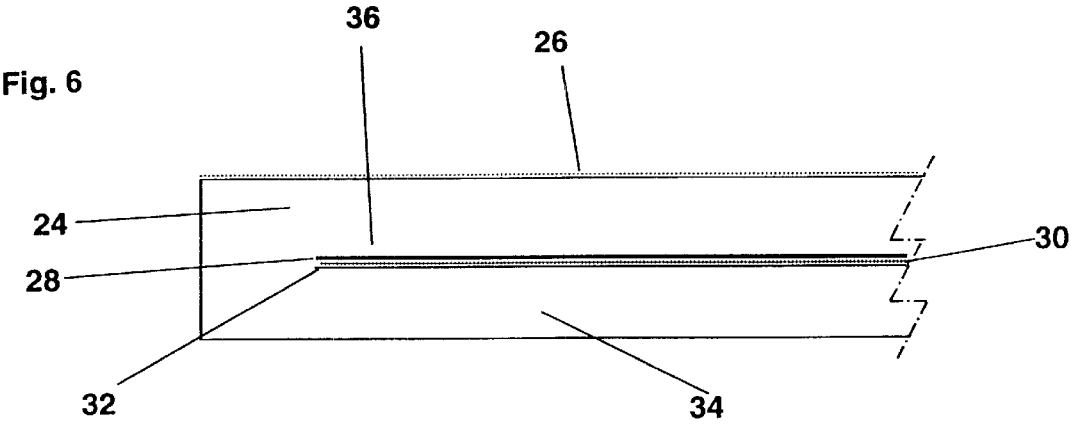
FIG. 6 is a sectional view of the writing surface of the present invention showing one embodiment of laminating the writing surface.
Figure 8:
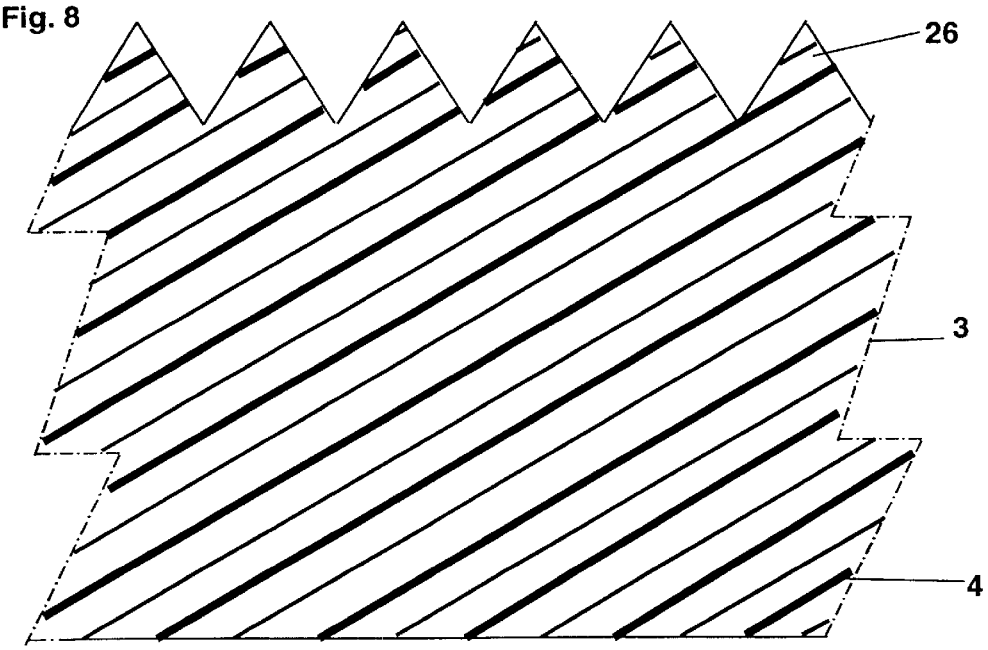
FIGS. 8 and 9 are surface perspective views of two embodiments of the writing surface of the present invention.
Figure 9:
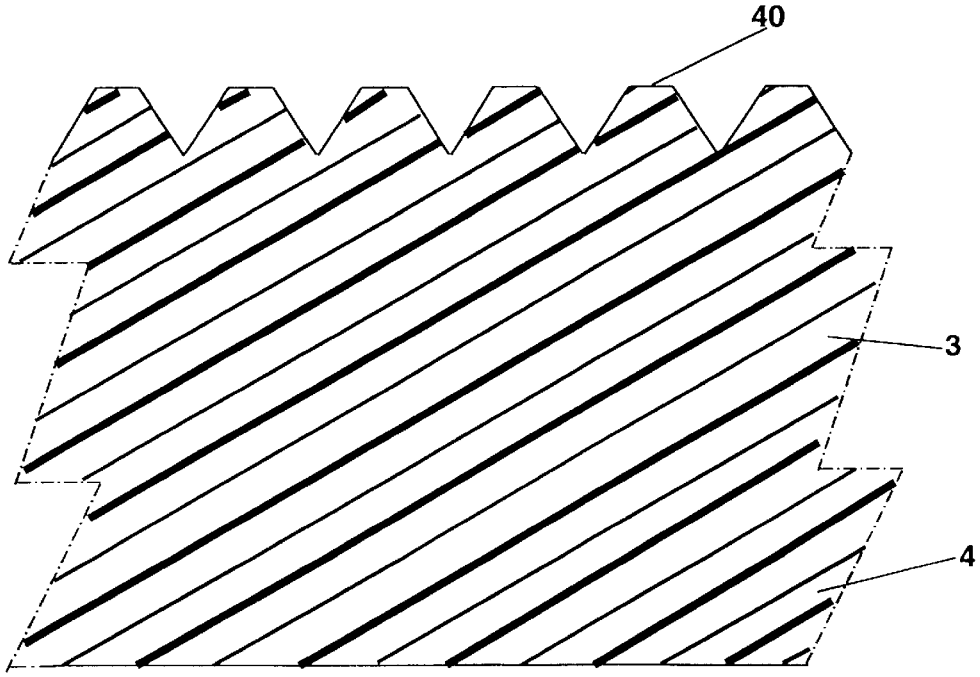

As shown in FIGS. 8 and 9, in another embodiment, the writing surface is constructed of chemical matte polyester lamination material that has been burnished with an abrasive material. As shown in FIGS. 8 and 9, the burnishing serves to scratch the surface sufficiently to increase the erasing ability of the surface but, at the same time, reduce smudging of pencil lines. In yet another embodiment, as shown in FIG. 6, the lamination process involves a three ply structure including encapsulating a printed piece of paper or plastic that contains any suitable graphics such as advertisements, calenders or other information. In another embodiment, a matte is on one side and gloss is on the other side.

In one example of constructing the writing surface of the present invention, a 10 mil chemical matte lamination material may be employed. The gloss side may also be 10 mil and thus, the total writing surface has a 20 mil thick final laminated panel. In one embodiment, the writing surface may be constructed of a "chemical matte" and a "gloss " from Transilwrap Company, Inc. For example, a lamination of seven parts polyester to three parts polyethylene glue may be employed to produce the matte surface. In another embodiment, the chemical matte surface, which is the writing surface after being burnished, may be laminated to any plastic substrate such as polyethylene or polypropylene. The substrate thickness may be closer for the desired rigidity. For example, a range of about 3 mil to about 20 mil may be chosen.

Figure 4:
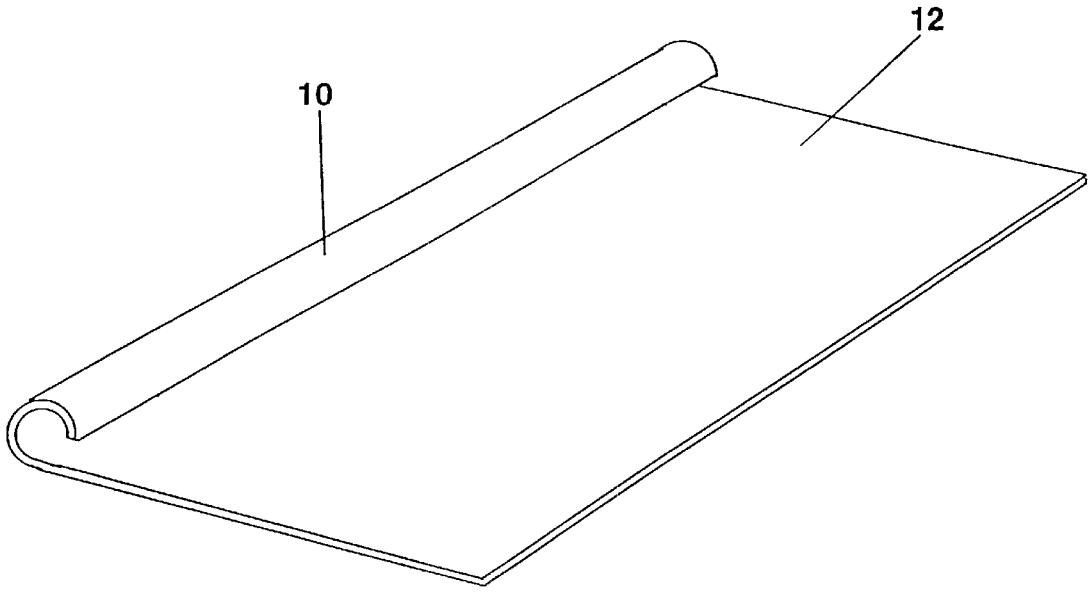
FIG. 4 is a perspective view of the writing surface of the present invention showing one embodiment of the present invention with one panel having a pencil molded holder.

In one embodiment, as shown in FIG. 4, part of the writing surface is formed in a shape to hold a writing utensil such as a pencil or pen. For example, the writing utensil face may include a pencil. For another embodiment, FIG. 6 shows a pencil holder formed by heat forming part of panel 12 into the desired shape. In another example, FIG. 8 shows a picture of ReflectaNote used for flash units.

In another embodiment, the writing surface may consist of two panels bonded together to form a hinge. The methods of bonding may include tape or any other suitable method that holds the two panels together but allows for sufficient flexing to flex to 180 degrees. In one example, FIG. 2 shows a ½" polyester tape (2 and 2*a*) that is applied to both sides of panels 1 and 1*a* to form a hinge. In yet another embodiment, matte lamination (3) with chemical matte surface (26) and gloss lamination (6), encapsulates paper or plastic (5) in the laminate's glue (4).

Figure 7:
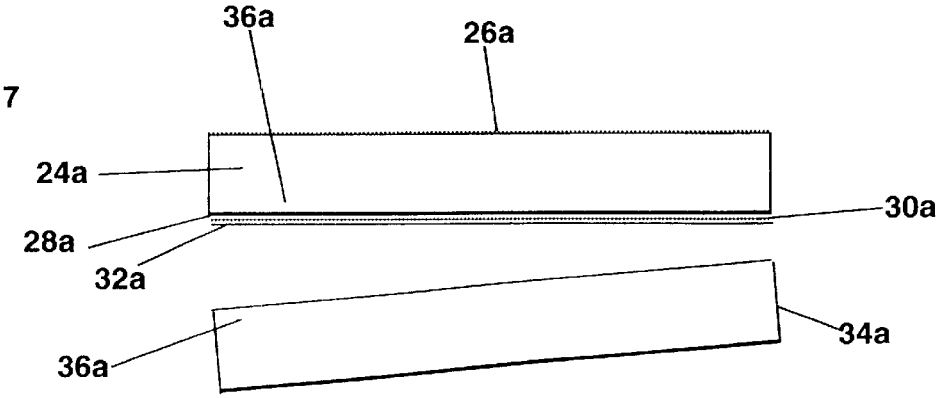
FIG. 7 is a sectional view of writing surface of the present invention showing one embodiment where the writing surface has an adhesive backing.

In another embodiment, as shown in FIG. 7, the writing surface is adhered to the back of a camera. In one example, the construction is matte lamination on one side with adhesive backing on the other. FIG. 8 shows an enlarged cross section partial view of FIG. 7. Paper or plastic (28) has had an adhesive backing (30) with release liner (32) added before lamination. After lamination and trimming, gloss laminate 34*a* becomes waste.

What is claimed is:

1. An erasable writing assembly, the assembly comprising:

a first panel comprising a permanently laminated three ply panel structure including: (a) at least one outer ply composed of a textured writable plastic surface with a finish sufficient to reduce pencil smudging but allow for pencil erasing; and (b) a middle ply with graphics; and a second panel comprising a permanently laminated three ply panel structure including: (a) at least one outer ply composed of a textured writable plastic surface with a finish sufficient to reduce pencil smudging but allow for pencil erasing; and (b) a middle ply with graphics;

wherein the first and second panels are bonded together to form a hinge; and wherein an end of the first panel, which end is farthest from the end hinged to the second panel, is molded in a substantially fixed shape sufficient to hold a writing utensil.

2. An erasable writing assembly, the assembly comprising:

a panel comprising a permanently laminated three ply panel structure including: (a) at least one outer ply composed of a textured writable plastic surface with a finish to reduce pencil smudging but allow for pencil erasing; and (b) a middle ply with graphics;

wherein an end of the panel is molded in a substantially fixed shape sufficient to hold a writing utensil.

* * * * *